US006412779B1

(12) United States Patent
Kenney

(10) Patent No.: US 6,412,779 B1
(45) Date of Patent: Jul. 2, 2002

(54) CARD GAME HAVING CARDS BEARING HIDDEN ICONS ALTERING GAME PLAY

(75) Inventor: Tyler B Kenney, La Cañada, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/632,116

(22) Filed: Aug. 3, 2000

(51) Int. Cl.[7] ..... A63F 1/00

(52) U.S. Cl. ..... 273/292; 273/306; 273/274; 273/303; 273/304; 273/305

(58) Field of Search ..... 273/292, 293, 273/296, 304, 308, 306; 434/331

(56) References Cited

U.S. PATENT DOCUMENTS

| | | | | | |
|---|---|---|---|---|---|
| D84,429 | S | * | 6/1931 | Moore | 273/292 |
| 2,162,946 | A | * | 6/1939 | Garrison | 273/152 |
| 4,534,562 | A | * | 8/1985 | Cuff et al. | 273/149 P |
| 5,169,155 | A | * | 12/1992 | Soules et al. | 273/293 |
| 5,219,172 | A | * | 6/1993 | Laughlin et al. | 273/304 |
| 5,224,712 | A | * | 7/1993 | Laughlin et al. | 273/304 |
| 5,364,106 | A | * | 11/1994 | Laughlin et al. | 273/304 |
| 5,401,032 | A | * | 3/1995 | Barnhart et al. | 273/293 |
| 5,522,623 | A | * | 6/1996 | Soules et al. | 283/91 |
| 5,967,517 | A | * | 10/1999 | Villano | 273/292 |
| 6,053,498 | A | * | 4/2000 | Waychoff | 273/292 |
| 6,053,741 | A | * | 4/2000 | Wood | 434/348 |
| 6,267,377 | B1 | * | 7/2001 | Griggs | 273/292 |

OTHER PUBLICATIONS

Walter B. Gibson, Hoyle's Modern Encyclopedia of Card Games, Doubleday, pp. 373–374.*

* cited by examiner

*Primary Examiner*—Benjamin H. Layno
*Assistant Examiner*—D Collins
(74) *Attorney, Agent, or Firm*—Roy A. Ekstrand

(57) ABSTRACT

A plurality of cards each having one or more primary value icons is utilized in a game similar to the game of "war" in which the relative power or value between cards is established on a preliminary basis by the number of primary value icons thereon. Each card in addition supports a coded image in which a plurality of colored image elements are formed. In at least some of the coded images a latent icon is printed and obscured by the remainder of the coded image. A decoder card sized and shaped to correspond to the remaining cards of the game includes an aperture supporting a tinted filter. When the tinted filter is placed over the coded image the latent icon therein becomes viewable. During game play the appearance of a decoder card allows the player to play the next card in combination with the decoder card to reveal the latent icon. The latent icon operates under the game rules to alter the power or value of the given card such as for example by doubling the card value.

6 Claims, 3 Drawing Sheets

CARD GAME HAVING CARDS BEARING HIDDEN ICONS ALTERING GAME PLAY

FIELD OF THE INVENTION

This invention relates generally to games and particularly to those played with a plurality of cards.

BACKGROUND OF THE INVENTION

Card games are perhaps one of the oldest types of games played. A virtually endless variety of card games have been created and provided through the years. Such games are often passed down from earliest times and are frequently assembled in various game books. Many card games use a novel or custom deck of cards specific for that particular game or a number of games. More commonly however, card games are played with a convention or standard deck of cards. Such standard card decks are divided into four suits each of which includes cards extending from ace through king. Thus, a total of fifty two cards plus a plurality of so-called "joker" cards are usually provided in a standard card deck.

Still other card games are played with a plurality of decks using small numbers of cards at a time. One of the most common multi-deck card games is known generally in the art as "blackjack or 21". In casino's or other gambling establishments the casino operators utilize a plurality of card decks to form a stack. This use of plural decks of cards allows the casino to frustrate attempts by players to mentally keep track of the preponderance of cards played in order to figure the rough or approximate odds on any given card at the top of deck.

One simply yet popular and long lasting card game, which has been handed down through countless generations of children is known generally known as "war". This simple game is played with one or more decks of cards and may be played by two or more players virtually without limit. The game is initiated by dealing the entire deck or decks of cards to the participating player. Each player stacks their allotment of cards in a stack faced down and commences a series of game rounds. A game round involves simply having each player take the top card from his or her stack and turn it face up in center pile. The pile is taken by the highest card played. The winner then picks up the entire group of played cards and places them in a separate pile face down. As each player finishes or plays through their respective card stack, they then take their accumulated winnings and form a face down stack and again continue game play. As the game progresses, some players have a overall increase in cards while others have an overall decrease of cards. This play continues until one player has successfully one all cards.

While prior art card games have enjoyed substantial popularity and in some instances been the focus of commercial success, there remains nonetheless a continuing need in the art for ever more interesting, amusing and entertaining card games. There remains a particular need in the art for card games which are relatively simple in game play allowing younger children to participate.

SUMMARY OF THE INVENTION

Accordingly, it is a general object of the present invention to provide an improved card game. It is a more particular object of the present invention to provide an improved card game which utilizes relatively simple rules and which may be played by young children.

In accordance with the present invention there is provided a card game comprising: a first plurality of cards each having a card face supporting one or more primary value icons and a coded image; a second plurality of cards each having an aperture and a color-tinted filter spanning the aperture; a plurality of latent icons within the coded images, the coded images visually obscuring the latent icons and the color-tinted filters revealing the latent icon when the filter is placed upon one of the coded images; and game rules for dividing the first and second pluralities of cards among players and thereafter playing each player's cards seriatim in successive rounds with the round winner being determined by the primary value icons and an altered value when one of the second plurality of cards is played with one of the first plurality of cards.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
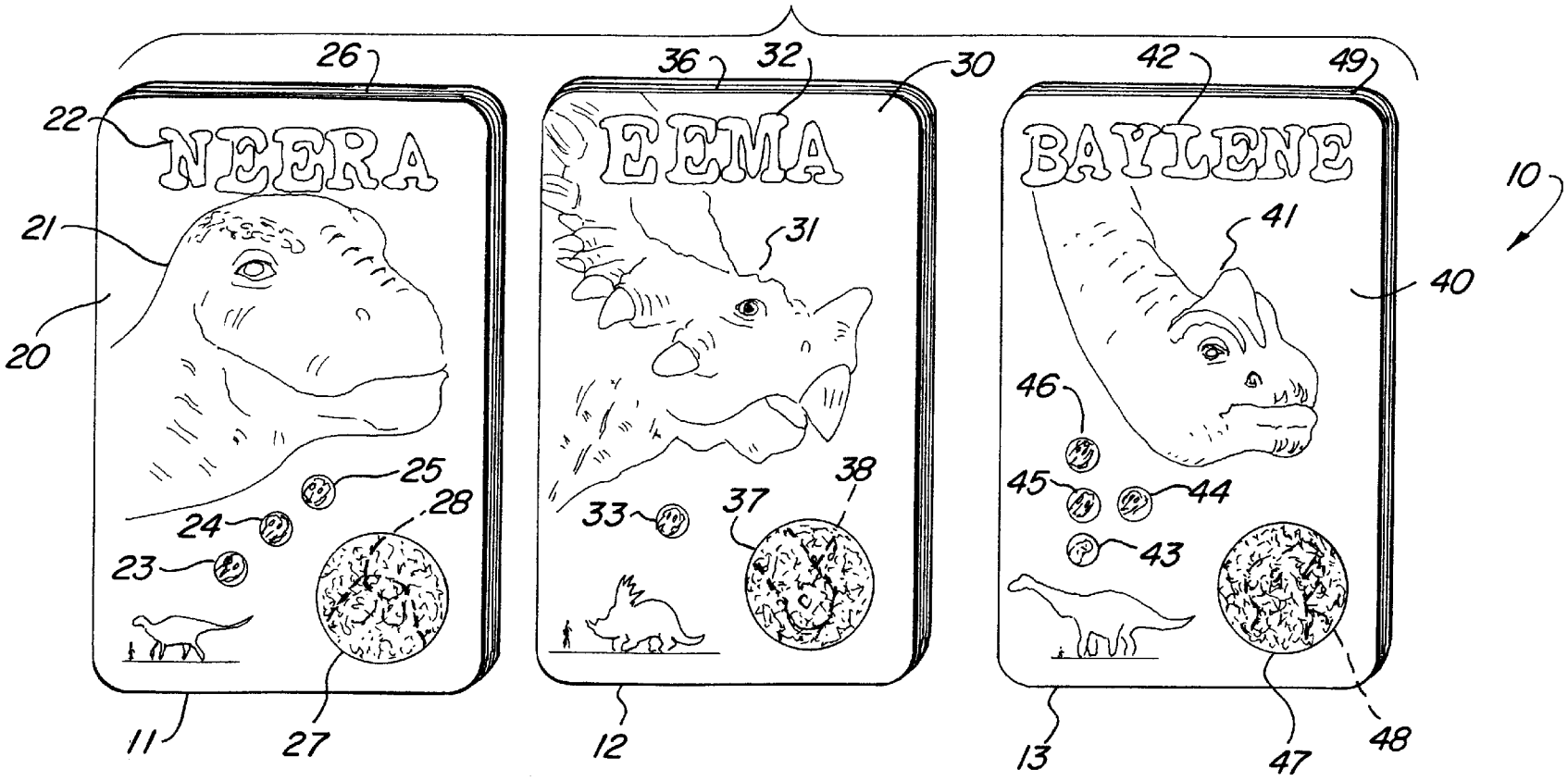
FIG. 1 sets forth a face-up view of a plurality of cards for the present invention card game.

FIG. 1 sets forth a plurality of cards utilized in playing the present invention game and generally referenced by numeral 10. Cards 10 are shown for purposes of illustration arranged in stacks 26, 36 and 49 each forming a plurality of cards 11, 12 and 13 respectively. It will be apparent to those skilled in the art, that while FIG. 1 illustrates a deck of cards generally referenced by numeral 10 which is comprised of pluralities of three different types of cards 11, 12 and 13 arranged in stacks 26, 36 and 49, a different number of card types may be utilized in forming deck 10 without departing from the spirit and scope of the present invention. Thus, it will be understood formed of three different card types repeated in three corresponding stacks is merely illustrative of the present invention game.

More specifically, card 11 which is repeated in stack 26 defines a face 20 having an image 21 and a name 22 formed thereon. Face 20 further includes a plurality of primary value icons 23, 24 and 25. Also supported upon face 21 is a coded image 27 within which a latent icon 28 is shown. In accordance with the present invention, coded image 27 is formed of a plurality of colored elements within which a latent icon 28 is formed in a particular color. Such latent images are well known in the art and rely upon a color selective filter to eliminate the obscuring portions of coded image 27 and reveal the image elements of latent icon 28. For example, the majority of coded image 27 may be formed using a reddish-brown or rust colored group of image elements while latent icon 28 may be formed of a light-green plurality of image elements. When so formed, latent image 28 becomes dominant if the user places a red colored transparent filter over coded image 27. The effect of the red filter upon coded image 27 provides for reducing the visibility of the reddish-brown elements within coded image 27 while accentuating the green elements of latent icon 28. This effect is well known in the art and is used in a variety of toys, games and other items. It is also well known in the art that different combinations of coded image colors and latent icon colors together with different color filters may be used to provide the desired effect. Such latent image objects in other colors are equally well known in the art.

Card 12 includes a face 30 having an image 31 and a name 32 formed thereon. Face 30 further supports a primary value icon 33 and a coded image 37. Coded image 37 is constructed in the same manner as coded image 28 and supports a latent icon 38. Latent icon 38 is preferably different from latent icon 28 but is formed in a similar color combination with coded image 37. As a result, coded image 37 allows viewing of latent icon 38 using the same color filter (seen in FIG. 2) which reveals latent icon 28 of card 11.

Card 13 includes a face 40 having an image 41, a name 42 and a plurality of primary value icons 43, 44, 45 and 46. Face 40 also supports a coded image 47 having a latent icon 48 obscured therein. Once again, it will be understood that latent icon 48 and coded image 47 are formed utilizing similar colors to coded image 27 and latent icon 28 to allow latent icon 48 to be revealed when viewed through the same filter used to reveal latent icons 28 and 38 of cards 11 and 12 respectively.

In accordance with the anticipated game play of the present invention game, the number of primary value icons on the card face of each of cards 11, 12 and 13 indicates their relative power or value with respect to each other. According, card 11 having three primary value icons is greater in value or power than card 12 having a single primary value icon. Conversely, card 11 is inferior in power or value to card 13 which has four primary value icons. As the game play set forth below is carried forward, the primary icon valuation of cards 11, 12 and 13 results in card 13 winning each contest with cards 11 and 12 while card 11 wins each contest with card 12. It will be apparent to those skilled in the art however, that a different primary value icon arrangement may be utilized such as numbers or the like without departing from the sprit and scope of the present invention. The essential element of the primary value icons upon the present invention card game is the ability to determine a winner between contending cards in each card of play as described below.

In further accordance with the present invention, the game set forth below provides for an altered value or power to a given card when and if its latent icon is revealed during game play. In the preferred play of the present invention game, the latent icon of a given card does not alter the card value unless and until it is played in combination with a decoder card such as decoder card 50 set forth in FIG. 2. To enhance this characteristic, the "visibility" of latent icons in each of the coded images of cards 11, 12 and 13 in the absence of viewing through the filter of a decoder card enforces this infrequent implacability of the latent icons.

In the anticipated play of the present invention game described below in greater detail, card deck 10 is shuffled as stacks 26, 36 and 49 are combined to randomize the distribution of cards 11, 12 and 13 therein. Accordingly, a different number of cards 11, 12 and 13 may be used in stacks 26, 36 and 49 to offset the distribution of cards 11, 12 and 13 within the deck.

Figure 2:
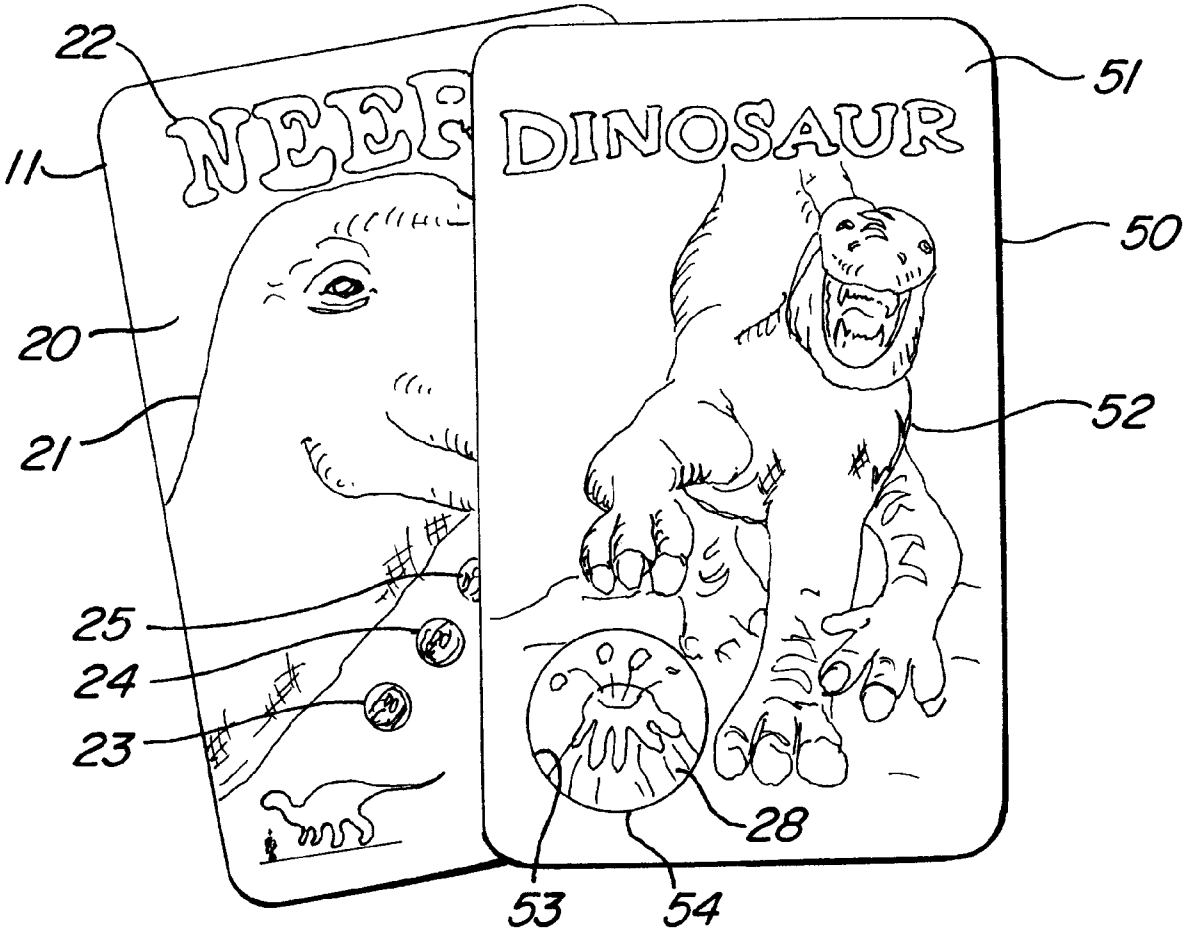
FIG. 2 sets forth a face-up view of a pair of cards used in playing the present invention game.

FIG. 2 sets forth an example of the application of a decoder card in accordance with the present invention game play whereby the value of a card is altered by its latent icon. In the example selected, card 11 has been played by a player following the appearance of a decoder card 50. Card 11 is fabricated in the manner described above and defines a face 20 having an image 21 and a name 22 formed thereon. As is also described above, card 11 supports a trio of primary value icons 23, 24 and 25. With temporary reference to FIG. 1, it will be recalled that card 11 also includes a coded image 27 having a latent icon 28 obscured therein.

Decoder card 50 includes a face 51 having an image 52 formed thereon. In accordance with the present invention, decoder card 50 also defines an aperture 53 within which a filter 54 is supported. Filter 54 is preferably formed of a transparent color tinted filter material such as thin plastic foil or the like. The selection of color tinting for filter 54 is arrived at in association with the color used in the coded images and latent icons of cards 11, 12 and 13 (described above). By way of example, it will be recalled that coded image 27, 37 and 47 of cards 11, 12 and 13 described in FIG. 1 support obscuring image elements of a reddish-brown or rust color while latent icons 28, 38 and 48 of cards 11, 12 and 13 shown in FIG. 1 are formed of image elements having a light green color.

Returning to FIG. 2, the selection of color tint for filter 54 to be used in combination with this illustrative color combination of coded image is optimized by utilizing a filter material which is substantially red in tint. The filtering action of the red tinted material of filter 54 reveals or emphasizes the light green image elements of latent icon 28 of card 11. It will be understood that a similar latent icon emphasis and revelation will occur when decoder card 50 having filter 54 is positioned above coded images 37 and 47 of cards 12 and 13 (seen in FIG. 1).

Thus, in accordance with the anticipated game play, the event shown in FIG. 2 arises when decoder card 50 has reached the top of a players card stack. In accordance with this game play and as is described below in FIG. 3 in greater detail, the player then removes decoder card 50 from the players stack and plays the next card face up. In the illustration of FIG. 2 this next card is card 11. Thereafter, the player having played card 11 then places decoder card 50 in the position shown in FIG. 2 revealing latent icon 28. In accordance with the game rules, latent icon 28 alters the value of card 11 to a different value than is provided by primary value icons 23, 24 and 25. In the embodiment of the present invention game set forth below, the effect of latent icon 28 results in doubling the value of card 11. As a result, card 11 in combination with decoder card 50 and icon 28 now has a play value of six rather than three in the particular round of game play taking place.

It will be apparent to those skilled in the art, that the present invention game may be given a further level of complexity by allowing each of cards 11, 12 and 13 (seen in FIG. 1) to be provided with a variety of latent icons to further complicate and add complexity to game play. For example, it may be desirable to provide cards 11 having different latent icons which in turn have different value effects. For example, different icons may be provided in the coded images of cards 11 which when revealed have game play results of altering the power value to three times or four times the primary icon value. A similar variation of cards 12 and 13 may be utilized to increase the complexity of game play. Thus, the present illustration of the present invention game in which the appearance of a latent icon simply doubles the value of a given card is used purely for illustration purposes and should not be taken by way of limitation.

Figure 3:
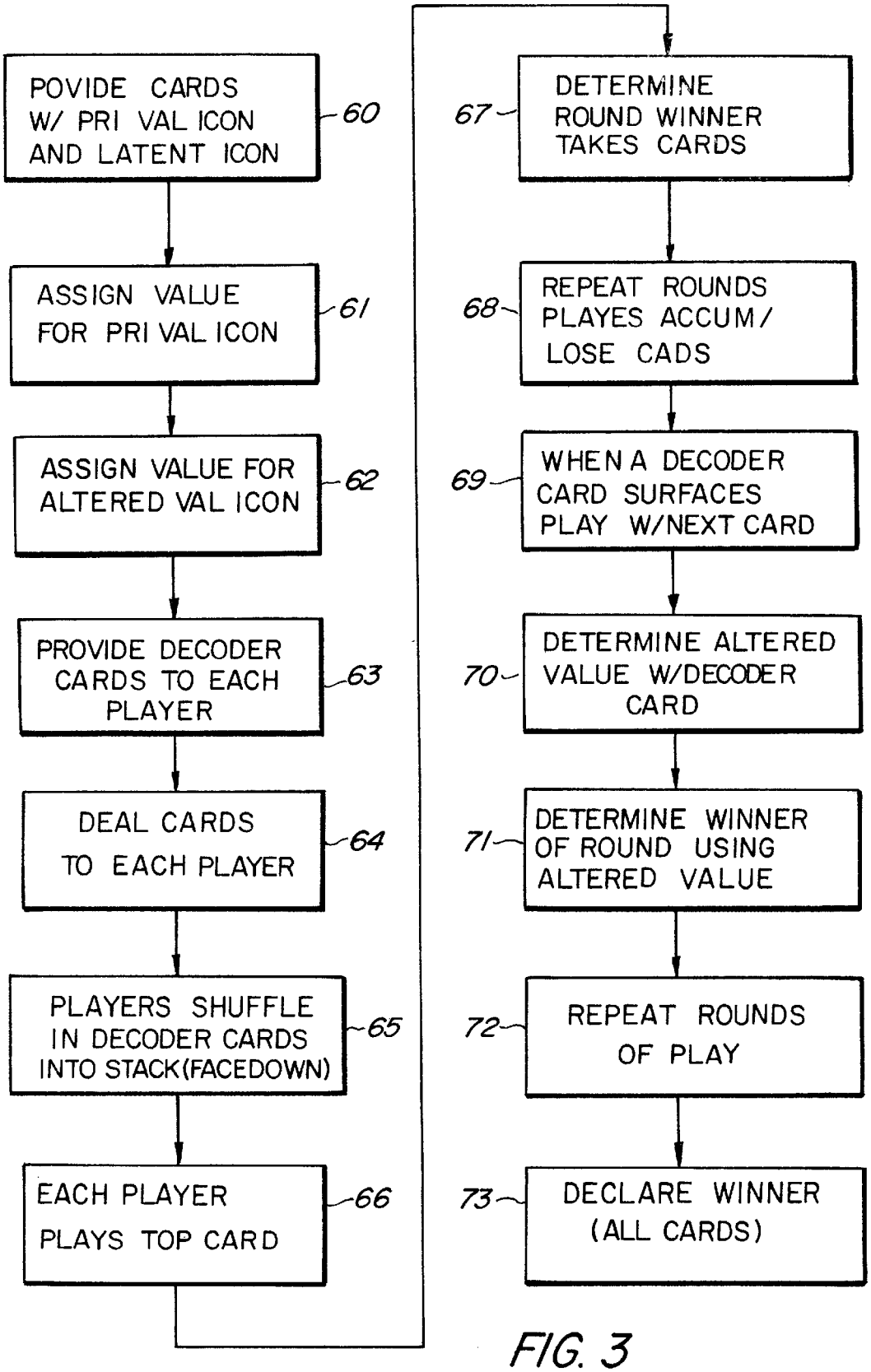
FIG. 3 sets forth a flow diagram of the game play of the present invention game.

FIG. 3 sets forth a flow diagram of an illustrative game play in accordance with the present invention. In the anticipated game play, at step 60 a plurality of cards forming a deck each of which has primary value icons and a latent icon is assembled. The deck is shuffled and prepared for dealing by a chosen dealer. At step 61, a value is assigned for relative values between cards based upon primary value icons. At step 62, an assigned value or effect on game play for altered value based upon the latent icon of each card is determined or assigned. As step 63, a limited number of decoded cards are provided by each player. The decoder cards preferably take the form of decoder card 50 shown in FIG. 2 in that they are readily hidden within the decks of remaining cards. At step 64, the dealer deals the plurality of cards to each player. In the anticipated play, each player receives an equal number of cards face down. Each player then arranges their allotment of cards in a face down stack. Each player then shuffles or otherwise inserts the limited number of decoder cards which the player posses into the stack. In the preferred play of the present invention game, the positions of decoder cards in a given players stack is hidden and random.

At this point, the initial round of the present invention game is ready to be played. This round is initiated at step 66 as each player takes the top card from their respective card stacks and places it face-up in a generally central play area. At step 67, a determination is made as to a round winner by observing the primary value icons on each of the played cards. In the absence of a decoder card play, the winner is thus determined and takes the cards to be placed upon a second stack for accumulation. At step 68, repeated rounds of play are undertaken as successive rounds cause certain players to accumulate to additional cards while other players tend to loose total cards. At step 69, a decoder card surfaces on one players stack allowing the player to remove the decoder card temporarily and play the next card. Thereafter, as is illustrated in FIG. 2, the decoder card is placed over the card having been played and the latent icon is observed. At step 70, a determination is made of the altered value of the card viewed through the decoder card. At step 71, a round winner is determined using the altered value of the played cards and the decoder revelation of a latent icon. In the illustration of the present invention set forth above, the power or value of a card played in combination with a decoder card is double the primary icon value. This value is then used in determining the winner of the round. At step 72, the repeat of round of play continues until one player has accumulated all cards at step 73. During the course of round play, certain players will loose all cards while others are able to continue. In the preferred method of game player, the winner is the individual having accumulated all of the cards and in essence defeated all players.

What has been shown is a card game having a plurality of cards each bearing one or more primary value icons and a coded image. Within at least some of the coded images a latent icon is viewable through a tinted filter supported within a decoder card. The appearance of a latent icon alters the play value or power of the card in accordance with predetermined game rules. An example of power value alteration by a latent icon is set forth as a doubling of the primary value icon power. It will be apparent to those skilled in the art that while the illustration of the present invention game set forth in FIGS. 1 and 2 hereof utilize images themed to correspond to dinosaurs and the like, the present invention game is by no means limited to any particular image theme. Thus, other images such as airplanes, weapons, soldiers or other types of images may be used without departing from the spirit and scope of the present invention.

By way of further variation, the effect or power alteration of latent icons may be varied to produce different effects. Thus, with temporary to FIG. 1, it may for example may be desirable to designate latent icon 28 as the above described doubling icon while designating latent icon 38 as an icon allowing a player to take the next three cards from the top of each opponents deck and place them on the bottom of that players deck. By way of further variation, latent icon 48 may allow a player to take a decoder card from the players opponents. These and other variations may be readily contemplated within the spirit and scope of the present invention.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A card game comprising:

a first plurality of cards each having a card face supporting one or more primary value icons and a coded image;

a second plurality of cards each having an aperture and a color-tinted filter spanning said aperture;

a plurality of latent icons within said coded images, said coded images visually obscuring said latent icons and said color-tinted filters revealing said latent icon when said filter is placed upon one of said coded images; and game rules for dividing said first and second pluralities of cards among players and thereafter playing each player's cards seriatim in successive rounds with the round winner being determined by said primary value icons and an altered value when one of said second plurality of cards is played with one of said first plurality of cards.

2. The card game set forth in claim 1 wherein said game rules include each player shuffling their respective cards from said first and second pluralities of cards to form a face-down stack.

3. The card game set forth in claim 2 wherein said game rules include each player participating in each round of play by taking the top card from their respective face-down stack and placing face-up.

4. The card game set forth in claim 3 wherein said game rules include a power-altering play initiated when a player's top card on the player's face-down stack is one of said cards in said second plurality, said power-altering play including placing the next card beneath said second plurality card face-up with said second plurality card upon it to reveal said latent icon and altering said valve of said primary value icon.

5. The card game set forth in claim 4 wherein said color-tinted filter are red, said coded images are generally reddish-brown and said latent icons are generally green.

6. A card game comprising:

a plurality of game cards each having a primary value and a coded image having a latent icon therein;

a plurality of decoder cards each having means for revealing said latent icons; and game rules for dividing said game cards and said decoder cards among players and for playing said game cards competitively based upon said primary value unit one of said decoder cards is played afterwhich the value of the game card following said decoder card is altered by revealing the one of said latent icons thereon.

* * * * *